US006401439B1

(12) United States Patent
Tetenborg et al.

(10) Patent No.: US 6,401,439 B1
(45) Date of Patent: Jun. 11, 2002

(54) DEVICE FOR MANUFACTURING, FILLING AND SEALING SACKS

(75) Inventors: Konrad Tetenborg, Lengerich; Hans-Ludwig Voss, Tecklenburg, both of (DE)

(73) Assignee: Windmöller & Hölscher, Lengerich (DE)

( * ) Notice: Subject to any disclaimer, the term of this patent is extended or adjusted under 35 U.S.C. 154(b) by 0 days.

(21) Appl. No.: 09/564,555

(22) Filed: May 4, 2000

(30) Foreign Application Priority Data

May 4, 1999 (DE) ..... 199 20 453
Aug. 4, 1999 (DE) ..... 199 36 660

(51) Int. Cl.[7] ..... B65B 9/13
(52) U.S. Cl. ..... 53/567; 53/570
(58) Field of Search ..... 53/567, 570, 571, 53/373.7

(56) References Cited

U.S. PATENT DOCUMENTS 4,115,978 A * 9/1978 Langemeyer et al. ..... 53/570
5,086,609 A * 2/1992 Tetenborg ..... 53/570

FOREIGN PATENT DOCUMENTS

DE 93 01 355 1/1994
EP 0 468 376 1/1992

* cited by examiner

*Primary Examiner*—John Sipos
(74) *Attorney, Agent, or Firm*—Jacobson Holman, PLLC

(57) ABSTRACT

The invention relates to device for manufacturing, filling and sealing thermoplastic sacks that are open on one side. Said device comprises a first welding and severing station for forming the sack with a bottom weld, a filling station and a second welding station for sealing the sack and comprises a first pair of gripping pliers as the pair of transport gripping pliers for accepting the sack at the first welding station; a second pair of gripping pliers that are arranged stationarily at the filling station; and a third pair of gripping pliers as the pair of transport gripping pliers that transport the sack from the filling station to the second welding station. The invention provides a fourth pair of gripping pliers as the pair of transport gripping pliers that accepts the sack from the first pair of transport gripping pliers through the in-line arrangement of a stationary pair of gripping pliers and delivers to the pair of gripping pliers, which are arranged stationarily at the filling station. Said fourth pair of gripping pliers assumes a delivery position to deliver the sack to the pair of gripping pliers that is arranged stationarily at the filling station and that lies in a plane that is higher by a distance (x) than its acceptance position for the sack.

7 Claims, 5 Drawing Sheets

DEVICE FOR MANUFACTURING, FILLING AND SEALING SACKS

The invention relates to a device for manufacturing, filling and sealing sacks as disclosed in the preamble of claim 1.

Such a device is disclosed, for example, in the DE 93 01 355 U. This document describes a class of device for manufacturing, filling and sealing thermoplastic sacks that are open on one side and have preferably side folds. This device comprises a first welding and severing station for forming the sack with a bottom weld, a filling station and a second welding station for sealing the sack. Here is a first pair of gripping pliers as the pair of transport gripping pliers for accepting the sack at the first welding station; a second pair of gripping pliers that are arranged stationarily at the filling station; and a third pair of gripping pliers as the pair of transport gripping pliers that transport the sack from the filling station to the second welding station. The DE 93 01 355 U has already managed to increase the timing rate, since a stationary pair of grippers is provided in the area of the filling station so that the sack can be held for filling in the filling station, while the other transport grippers can already carry out their lifting motion to accept new sacks.

The EP 0 468 376 B2 also discloses this class of device, which is designed to reduce the transversal distance between the individual processing stations and thus reduce the overall length of the device. To this end, the pairs of gripping pliers are moved vertically up and down through the vibratory motions of an eccentric in the region of the acceptance or delivery of sacks in order to be able to pick up the sack by its edge without having to swing the pair of gripping pliers at an opening angle of 180°. Since the pairs of gripping pliers must be swung completely open in order to accept sacks, it is necessary to provide a comparatively large amount of space inside the device, which opposes any reduction in the overall length.

The object of the invention is to improve this class of device so that the processing rate of the machine is increased and at the same time the entire device can be built more compactly.

The invention solves this problem with the features of claim 1. According to the characterizing features of claim 1, a fourth pair of gripping pliers is provided as the pair of transport gripping pliers that accepts the sack from the first pair of transport gripping pliers through the in-line arrangement of a stationary pair of gripping pliers and delivers to the pair of gripping pliers, which are arranged stationarily at the filling station. The fourth pair of gripping pliers assumes a delivery position to deliver the sack to the pair of gripping pliers that is arranged stationarily at the filling station and lies in a plane that is higher by a distance (x) than its acceptance position for the sack.

This arrangement makes it possible for a compact and space saving construction of the stationary pair of gripping pliers, especially in the area of the filling station, where owing to the plurality of components, like the various pairs of pliers, for example the additional suction mechanism for opening the sacks.

In contrast to the prior art, there is no need to pull this pair of gripping pliers vertically to the top in order to pick up the end of the sack. Rather this stationary pair of gripping pliers can be arranged stationarily. A relatively small opening angle is sufficient, since owing to the higher delivery position the upper end of the sack can be passed by the additional fourth pair of gripping pliers from the below into the pickup space formed between the stationary pairs of gripping pliers.

Other especially preferred embodiments follow from the dependent claims following the main claim.

The advantageous result of the coupling motion of the pairs of gripping pliers, as disclosed in the features of the dependent claims, is that the fourth pair of gripping pliers can be moved so as to lead the first and third pair of gripping pliers, which are coupled together in their motion so that the timing rate can be further improved due to the improved acceptance management of the sacks.

Other details and advantages of the invention are explained in detail with reference to one embodiment shown in the drawings.

Figure 1:
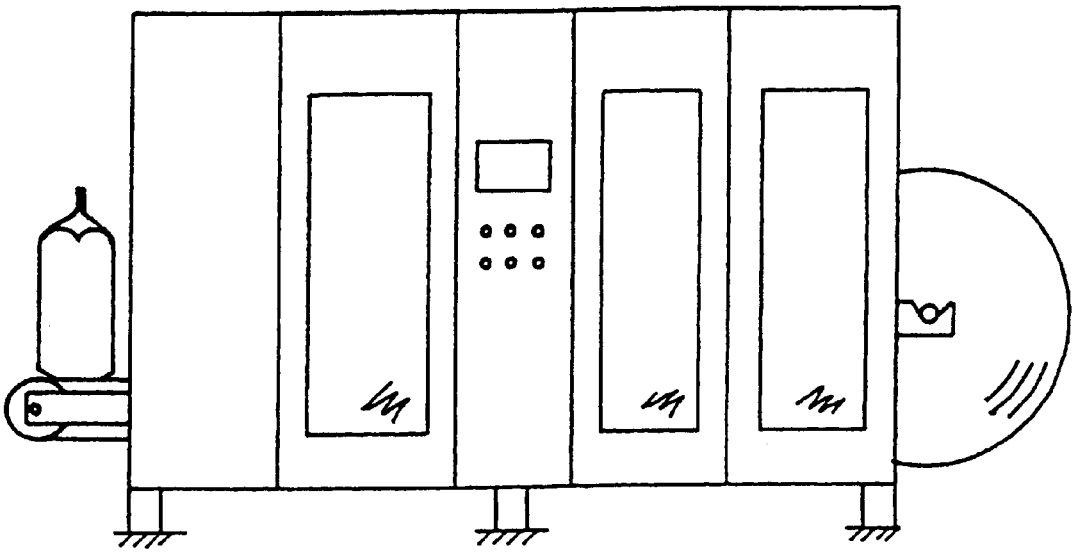
FIG. 1 is a side view of the device.

The device depicted in the drawing for manufacturing, filling, sealing and carrying away of thermoplastic sacks comprises a machine with a relatively short overall length. All of the processing stations are arranged in one single machine frame.

Figure 2:
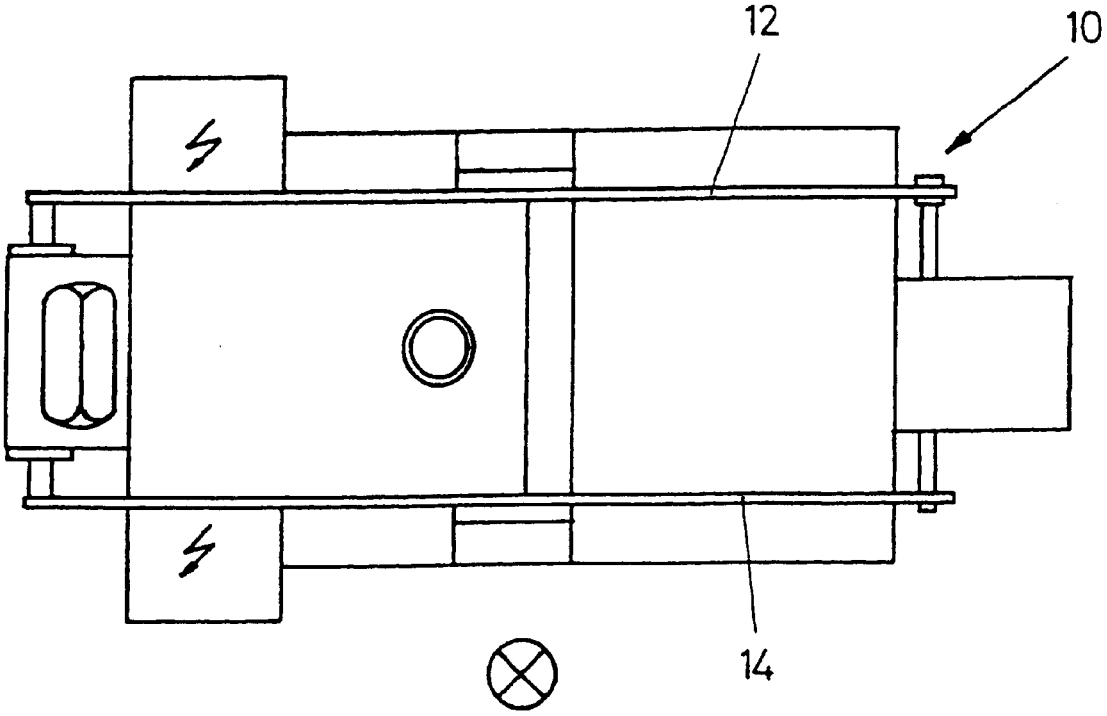
FIG. 2 is a top view of the device.

The machine frame 10 comprises two side members 12 and 14, which are connected together with conventional traverses (not illustrated). The machine frame is encased with plates, doors and windows, as shown in FIGS. 1 and 2. One end of the machine frame exhibits on the side members 12 and 14 an unwinding unit 16 for the web of thermoplastic blown film, wound into a supply roll. Preferably the unwinding unit has side folds, in which the roll of blown film 18 is hung. The web of blown film 20, hauled off the roll of blown film 18, is pulled forward at a given cycle rate over deflecting rollers by a pair of forward draw rollers 22. Between the deflecting or guide rollers 24, 26 the web of blown film, hauled off the supply roller 18, is pulled by a pendulum roller 28 into a web loop, which forms a web storage. The blown film web, which is pulled forward at a timed rate, is hauled off the web storage, which fills again in the standstill phases of the web of blown film 20 in that the pendulum roller 28 draws such a large segment from the supply roller 18 that the loop receives again its length, storing the segment length. The pendulum roller 28 is mounted between two levers 30, which are mounted on the machine frame and which are swung at a given cycle rate by a pneumatic cylinder 32 out of its swung in state into its illustrated swung out state.

Figure 3:
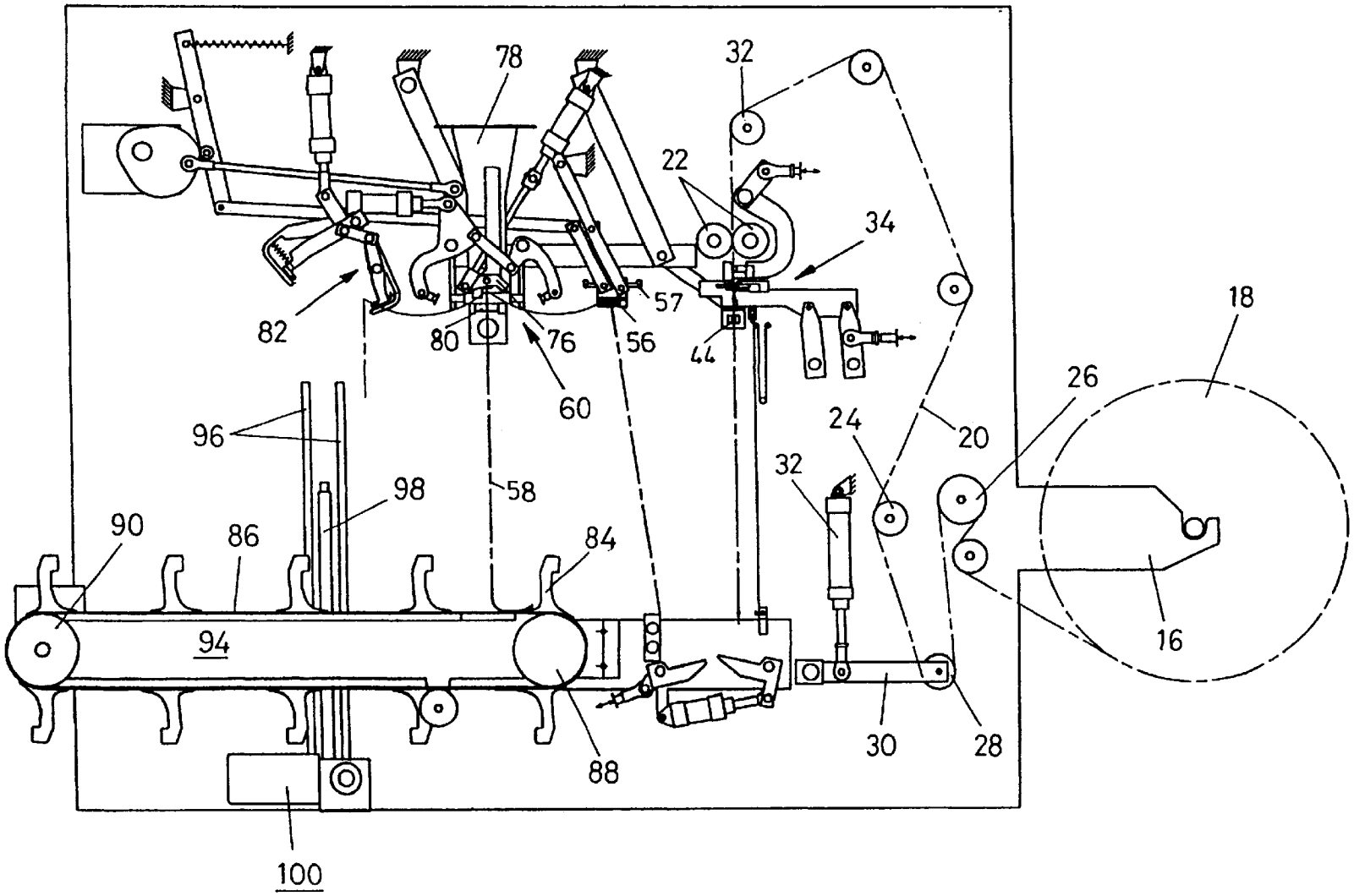
FIG. 3 is a schematic drawing of a side view of the device with the front wall removed.

The pair of forward draw rollers 22 pulls the web of blown film 20, flowing off the deflecting roller 32, out into a vertical direction and pushes it between a cross welding and cross severing mechanism 34. This cross welding and cross severing mechanism exhibits in the conventional manner two interacting welding jaws and a cutting blade (cf. FIG. 3).

The transport system for those sacks that are to be filled and those that are filled can be explained with reference to FIG. 6. Mounted on guide arms 36, 38, which are fastened to the frame, is a support 40, which forms a four joint system, thus a coupling. This support is connected to an inclined bracket 42, to whose side below the opening rims of the tubular segments there is a first pair of gripping pliers 44, which is indicated by the illustrated gripping jaws.

Hinged to the guiding arm 38 is a connecting rod 46, which can be moved back and forth by a crank 50, driven by a gear motor 48. In so doing, the swivel motion of the support 40 is so large that the pair of gripping pliers 44, enclosing the sack segment 58 below the cross welding and cross severing mechanism 34, moves the sack segment by one cycle length along the arc 52 into a delivery station 54, in which the gripping pliers 44 deliver the sack section to a stationary pair of gripping pliers 57. After grasping the sack segment with a pair of gripping pliers 56 that grasp the opening rims from the top, said pair of gripping pliers 57 advances the sack segment 58 to the filling station 60. In FIG. 6 the pair of gripping pliers 57 is depicted in the opened position after the sack segment has been delivered to the pair of gripping pliers 56. The pair of gripping pliers 56 is carried by levers 62, 64, both of which are hinged to a thrust rod 66 and form with their hinged points on the thrust rod and the grippers a four joint system. The lever 64 is a two armed lever, whose top lever arm 68 is mounted stationarily on the frame in the manner illustrated. The thrust rod 66 is hinged to a two armed lever 70, which is mounted stationarily on the frame and whose top lever arm is loaded by a tension spring 72 in the manner illustrated. The crank 50 is designed in the illustrated manner as a cam plate. A cam roller 74, which is mounted on the lower lever arm of the two armed lever 70, rolls down this cam disk. The thrust rod 66 is driven in such a manner by its cam plate-lever-cam roller drive that the pair of gripping pliers 56 advances and transfers the sack segment to the pair of gripping pliers 76.

The pair of gripping pliers 76 grasps below the fill funnel 78 on the side of the opening areas of the sack segments. On the support 40 there is another pair of gripping pliers 80, which passes the opening rims of the filled sacks that are pulled tight again, after filling, to a welding station 82, where a pair of welding jaws (not illustrated in FIG. 6) welds the tightly pulled opening rims of the sack with a cross weld.

Below the filling station 60 there is a conveyor belt 86, which is provided with posts 84 and which runs over one sided drive and deflecting rollers 88, 90 and which conveys the filled sacks 92 in synchronous timing with their filling away from the filling and welding stations 60, 82. The drive and deflecting rollers 88,90 of the conveyor belt 86 are mounted on the ends of a horizontal support 94, which can be raised and lowered by a spindle drive 98 in stationary guides 96. In this respect the spindle drive 98 can be driven by means of a gear motor 100.

Figure 5:
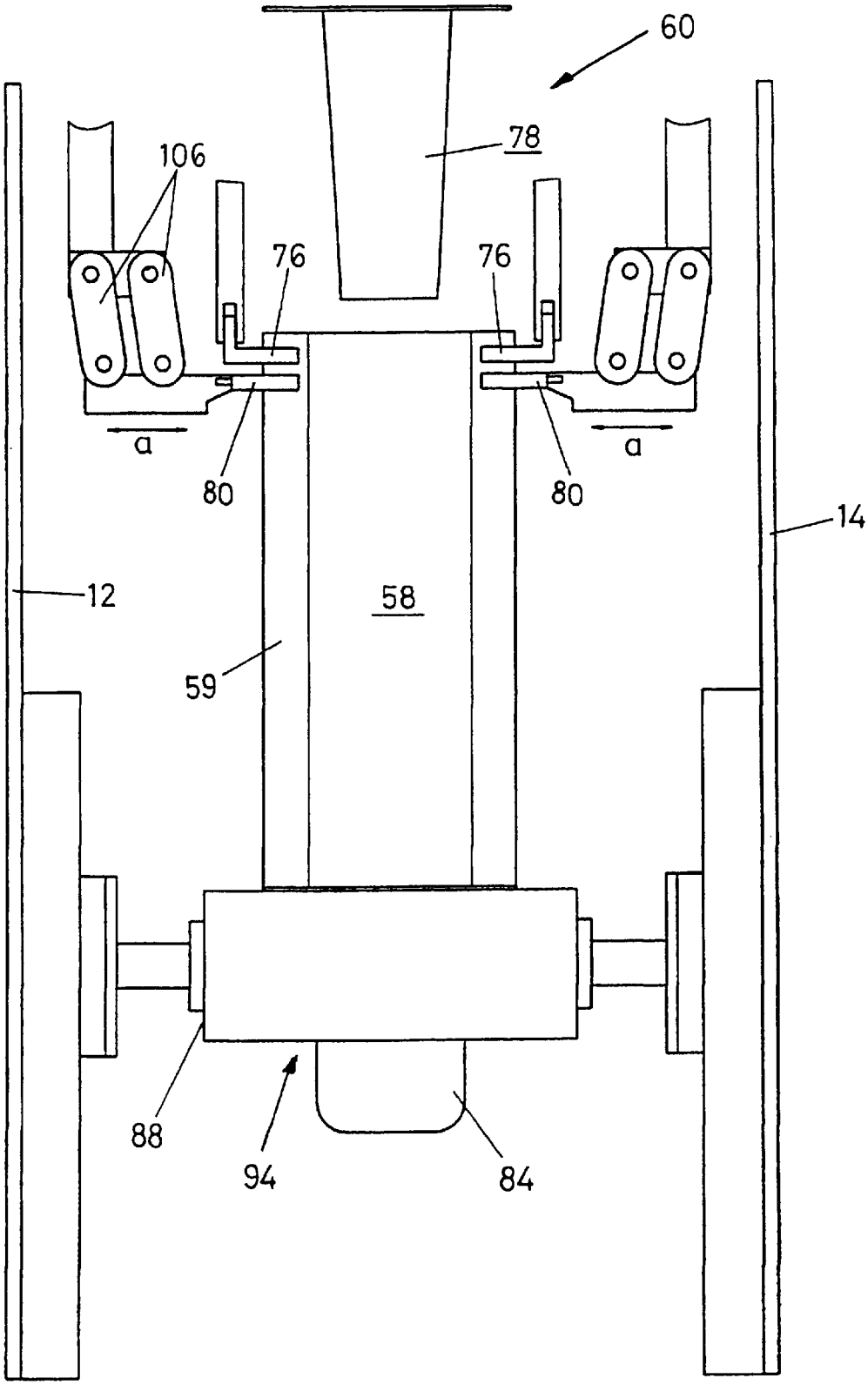
FIG. 5 is a view of one detail of the filling station, rotated by 90° relative to the view in FIG. 4.

FIG. 5 depicts a filling station 60. Between the side members 12 and 14 there is a conveyor belt 94 with a deflecting roller 88. As described above, there are posts 84 on the conveyor belt 94. Between the filling funnel 78 and the conveyor belt 94 there is sack 58, waiting to be filled. At the point in time illustrated here, the sack is held simultaneously by the pair of gripping pliers 80 and the pair of gripping pliers 76, mounted stationarily in the filling station. To grasp the side fold areas 59 of the sack 58 or to detach the pair of gripping pliers from the side fold area 59, the pairs of gripping pliers 80 are moved in the direction of arrow a by means of the double guide arms 106.

Figure 4:
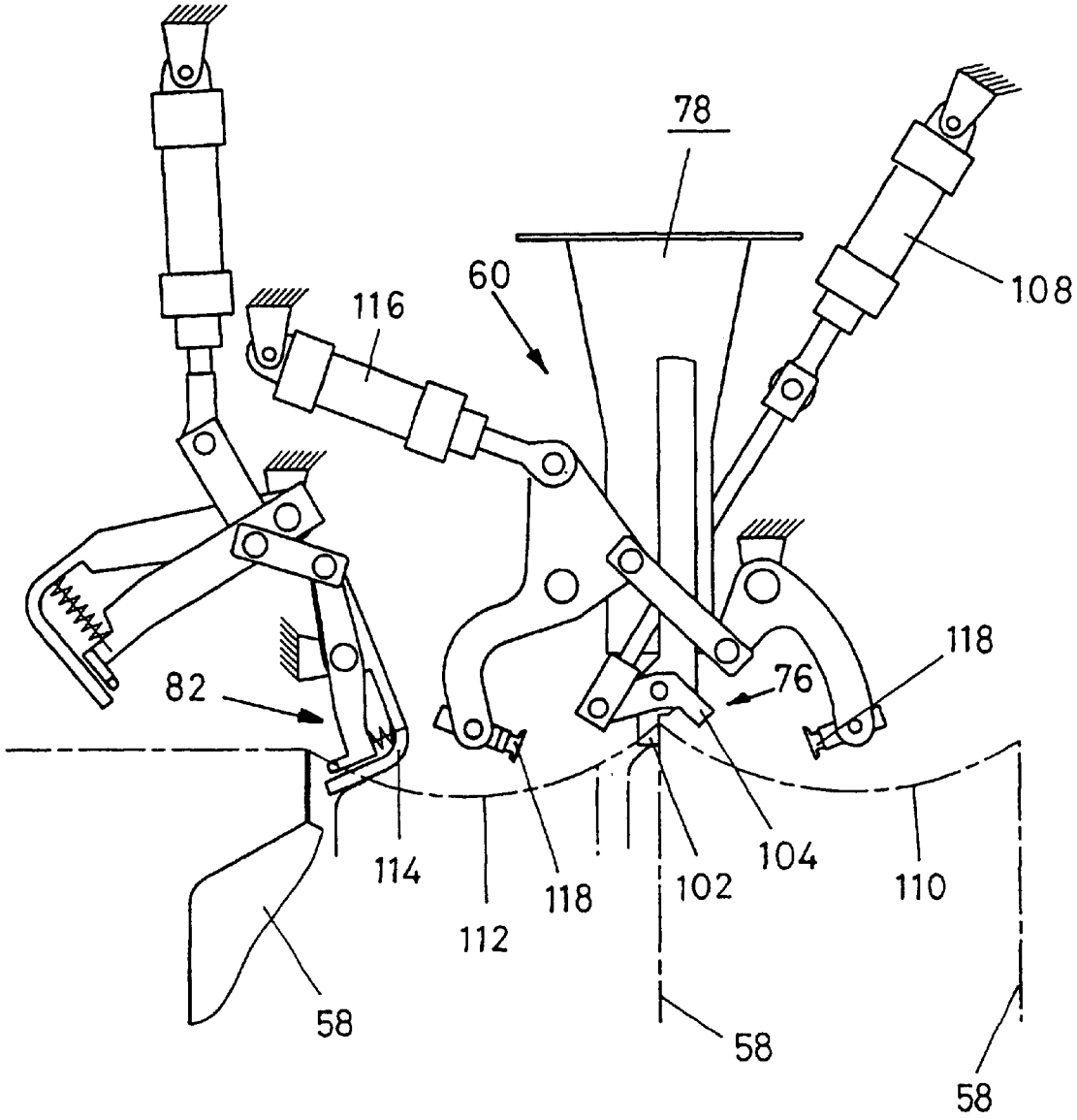
FIG. 4 is an enlarged view of one part of the filling station and the second welding station from FIG. 3.

The stationary pairs of gripping pliers 76 do not have to be opened 180° in order to grasp the top end of the sack 58. The requisite opening movement of the respective pairs of pliers 102 and 104 of the stationary pairs of gripping pliers 76 can be explained with reference to FIG. 4. The pair of gripping pliers 102 is fixed vertically in a bottom position, as evident from the drawing in FIG. 4. The pair of gripping pliers 104 that engages so as to clamp together with the pair 102, can be swung open by means of a pneumatic piston cylinder arrangement 108, whereby this angle forms only an acute angle. The result is that the pairs of grippers exhibit only a comparatively small pickup opening. To thread the top end of the sack 58 reliably into the comparatively narrow pickup gap, the fourth pair of gripping pliers 56 passes over a transport path 110, which is shown in FIG. 4 with a dashed dotted line. The delivery position for delivering the sack 58 to the pair of gripping pliers 76, mounted stationarily on the filling station, lies in a plane, which is higher by a distance (x) than its acceptance position 54 for the sack 58. This difference in height x is shown in FIG. 6.

Figure 6:
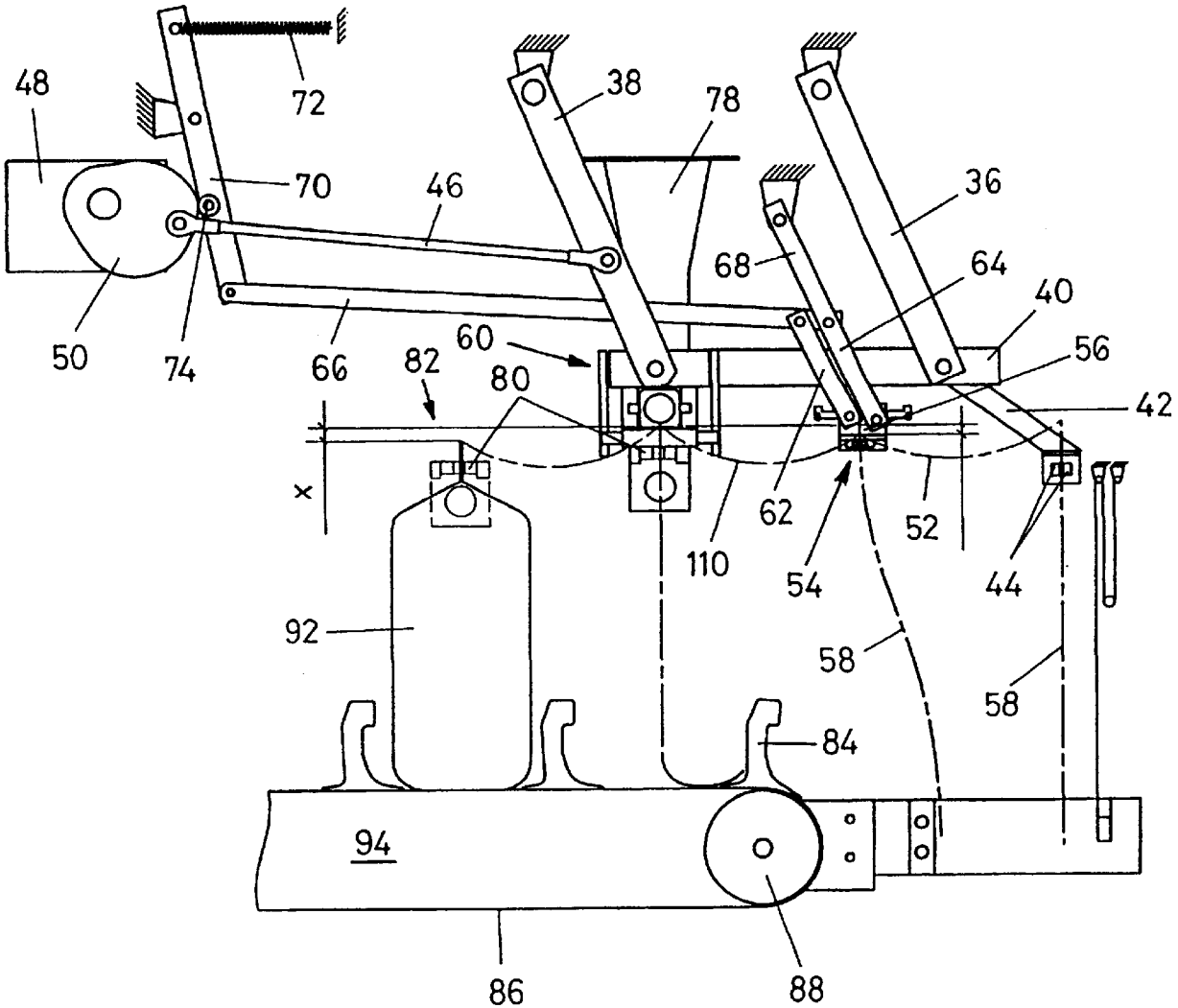
FIG. 6 is an enlarged view of the pairs of gripping pliers from FIG. 3 as they carry away the sack sections in a synchronized manner.

After filling the sack 58, said sack is grasped by the pair of gripping pliers 80, as shown in FIG. 6, below the pair of gripping pliers 76 (FIG. 5). Even this pair of gripping pliers can be positioned again on the side, like the pair of gripping pliers 80, in the direction of the arrow as shown in FIG. 5. To remove the filled sack whose top end area is pulled tight again by the grippers, the top rim area, thus the area of the sack above the pair of transport gripping pliers 80, must move away from the stationary jaws 102 of the pair of gripping pliers 76, as shown in FIG. 4 by the dashed line. Owing to the elasticity of the plastic and the resulting resiliency, this top rim area restores itself, a state that is also shown in the drawing. The pair of transport grippers 80 swings the sack, which simultaneously rests on the transport belt 94 and is conveyed by it, along the dashed dotted line 112. At the same time this line reproduces the unimpeded course of motion for the uppermost rim area of the sack 58. In the welding station 82 the sack 58 assumes a position that lies below the position in the filling station 60 by a height difference x (cf. FIGS. 6). Thus the pair of grippers 80 pushes the top rim of the sack downward so that the residual air is forced out of the top portion of the filled sack. In the region of the welding station 82 the top end of the sack must once again avoid the welding jaws 114, as also shown in the drawing in FIG. 4. Here, too, the top end stands upright again due to the intrinsic elasticity of the plastic so that the tightly pulled top rim area of the filled sack 58 can be welded in the welding station 82.

Finally FIG. 4 depicts the conventional pair of suction mechanisms 118, which can be swung open by means of a pneumatic piston cylinder arrangement 116. The bag can be removed to the side by the suction mechanisms in order to accommodate the filling funnel 78 after it is lowered. The configuration of the pair of suction mechanisms already belongs to the prior art and is, therefore, not explained in detail at this point.

What is claimed is:

1. Device for manufacturing, filling and sealing thermoplastic sacks that are open on one side and have preferably side folds, said device comprising a first welding and severing station for forming the sack with a bottom weld, a filling station and a second welding station for sealing the sack and a first pair of gripping pliers as the pair of transport gripping pliers for accepting the sack at the first welding station; a second pair of gripping pliers that are arranged stationarily at the filling station; and a third pair of gripping pliers as the pair of transport gripping pliers that transport the sack from the filling station to the second welding station, characterized in that a fourth pair of gripping pliers (56) is provided as the pair of transport gripping pliers that accepts the sack (58) from the first pair of transport gripping pliers (44) through the in-line arrangement of a stationary pair of gripping pliers (57) and delivers to the second pair of gripping pliers (76), which are arranged stationarily at the filling station (60); said fourth pair of gripping pliers (56) assumes a delivery position to deliver the sack to the second pair of gripping pliers that is arranged stationarily at the filling station and which delivery position lies in a plane that is higher by a distance than its acceptance position (54) for the sack (58) from said gripper pliers.

2. Device, as claimed in claim 1, characterized in that the stationary pair of gripping pliers (76) at the filling station comprises a stationary and vertical pair of gripping pliers (102) and a pair of gripping pliers (104) that can be swung out togehter with said former pair.

3. Device, as claimed in claim 2, characterized in that the first pair of gripping pliers (44) and the third pair of gripping pliers (80) are mounted rigidly on a coupling (40), which forms a four joint system together with guide arms (36, 38), mounted stationarily on the frame.

4. Device, as claimed in claim 3, characterized in that the four joint system, formed by the coupling (40) and the guide arms (36, 38), which are pivot mounted stationarily on the frame, is connected to a motor driven crank (50) by means of a connecting rod (46).

5. Device, as claimed in claim 3, characterized in that the fourth pair of gripping pliers (56) is carried by two levers (62, 64), both of which are hinged to a thrust rod (66) and form with their hinged points on the thrust rod (66) and the grippers a four joint system, whereby one of the levers (64) is a two armed lever, one of whose lever arms (68) is mounted stationarily on the frame; and whereby the thrust rod (66) is hinged to another two armed lever (70), which is mounted stationarily on the frame and whose top lever arm is loaded by a tension spring (72), while a cam roller (74), which is mounted on the lower lever arm, rolls down a cam disk.

6. Device, as claimed in claim 5, characterized in that the cam plate is designed in such a manner that the fourth pair of gripping pliers (56) advances the appropriately grasped sack segment (58) relative to the first pair of gripping pliers (44) to the filling station (60) and transfers to the pair of gripping pliers (76) arranged there.

7. Device for manufacturing, filling and sealing thermoplastic sacks that are open on one side and have preferably side folds, said device comprising a first welding and severing station for forming the sack with a bottom weld, a filling station and a second welding station for sealing the sack and a first pair of gripping pliers as the pair of transport gripping pliers for accepting the sack at the first welding station; a second pair of gripping pliers that are arranged stationarily at the filling station; and a third pair of gripping pliers as the pair of transport gripping pliers that transport the sack from an acceptance position from the second gripping pliers at the filling station to the second welding station, characterized in that the third pair of gripping pliers (80) for transporting the second sack (58) to the second welding station (82) assumes a delivery position at the second welding station and which delivery position lies in a plane that is lower by a distance than its acceptance position for the sack (58) in the filling station (60).

* * * * *